US008939695B2

(12) United States Patent
Price et al.

(10) Patent No.: US 8,939,695 B2
(45) Date of Patent: Jan. 27, 2015

(54) METHOD FOR APPLYING A METAL END TO A CONTAINER BODY

(75) Inventors: Trevor Price, North Canton, OH (US); Jeremy Morin, Canal Fulton, OH (US); Dave Dunn, Carrollton, OH (US)

(73) Assignee: Sonoco Development, Inc., Hartsville, SC (US)

( * ) Notice: Subject to any disclaimer, the term of this patent is extended or adjusted under 35 U.S.C. 154(b) by 684 days.

(21) Appl. No.: 13/161,713

(22) Filed: Jun. 16, 2011

(65) Prior Publication Data

US 2012/0321415 A1 Dec. 20, 2012

(51) Int. Cl.

| | |
|---|---|
| ***B21D 51/30*** | (2006.01) |
| ***B21D 51/26*** | (2006.01) |
| ***B65B 7/28*** | (2006.01) |

(52) U.S. Cl.

CPC ..... *B21D 51/2653* (2013.01); *B65B 7/28* (2013.01)

USPC ..... 413/4; 413/5; 413/27

(58) Field of Classification Search

CPC ..... B21D 51/26; B21D 51/2653; B21D 51/2661; B65B 7/28

USPC ..... 413/2, 4–7, 26, 27; 72/379.4; 53/485, 53/487, 489

See application file for complete search history.

(56) References Cited

U.S. PATENT DOCUMENTS

| | | | |
|---|---|---|---|
| 2,828,903 | A | 4/1958 | Adkins |
| 3,073,478 | A | 1/1963 | Henchert |
| 3,405,439 | A | 10/1968 | Uemura |
| 3,406,891 | A | 10/1968 | Buchner et al. |
| 3,549,440 | A | 12/1970 | Adcock et al. |
| 3,616,047 | A | 10/1971 | Kehe |
| 3,625,785 | A | 12/1971 | Holmstrom et al. |
| 3,694,609 | A | 9/1972 | Kennedy |

(Continued)

FOREIGN PATENT DOCUMENTS

| | | |
|---|---|---|
| CA | 2 489 218 A1 | 7/2005 |
| CH | 422 690 | 10/1966 |

(Continued)

OTHER PUBLICATIONS eLIBRARY.RU—Advances in fusion bonding techniques for joining thermoplastic matri . . . [online] [retrieved Jan. 14, 2011]. Retrieved from the Internet: <URL: http://elibrary.ru/item.asp?id=585705>. 1 page.

(Continued)

*Primary Examiner* — Debra Sullivan
(74) *Attorney, Agent, or Firm* — Alston & Bird LLP

(57) ABSTRACT

A metal end is applied and sealed to a plastic or paper/plastic composite container body by a crimp-seaming or double-seaming operation. The metal end has an outer curl joined to a compound-angle chuck wall that extends down from the curl. The chuck wall has an upper part that is substantially linear and at an angle α1 with respect to an axis of the end, and a lower part that is substantially linear and at a larger angle α2 with respect to the axis. The compound-angle chuck wall allows a substantial diametral clearance between a lower end of the lower part of the chuck wall and the inner surface of the container body, while there is substantially zero clearance, or preferably an interference fit, between the upper part of the chuck wall and the inner surface of the container body. Accordingly, the chuck wall guides the end into concentric alignment with the container body during application.

14 Claims, 9 Drawing Sheets

(56) References Cited

U.S. PATENT DOCUMENTS

| | | | | |
|---|---|---|---|---|
| 3,774,801 | A | 11/1973 | Gedde | |
| 3,843,014 | A | 10/1974 | Cospen et al. | |
| 3,868,917 | A | 3/1975 | Arfert | |
| 3,909,326 | A | 9/1975 | Renck | |
| 3,912,154 | A | 10/1975 | Godar | |
| 3,934,749 | A | 1/1976 | Andrulionis | |
| 3,978,232 | A | 8/1976 | Dodsworth et al. | |
| 3,988,185 | A | 10/1976 | Johnson et al. | |
| 4,093,102 | A | 6/1978 | Kraska | |
| 4,095,390 | A | 6/1978 | Knudsen | |
| 4,217,843 | A | 8/1980 | Kraska | |
| 4,241,864 | A | 12/1980 | Kessler | |
| 4,448,322 | A | 5/1984 | Kraska | |
| 4,530,442 | A | 7/1985 | Vogel, Jr. et al. | |
| 4,606,472 | A | 8/1986 | Taube et al. | |
| 4,626,157 | A * | 12/1986 | Franek et al. | 413/1 |
| 4,643,330 | A | 2/1987 | Kennedy | |
| 4,667,842 | A | 5/1987 | Collins | |
| 4,674,649 | A | 6/1987 | Pavely | |
| 4,711,362 | A | 12/1987 | Korcz et al. | |
| 4,716,755 | A | 1/1988 | Bulso, Jr. et al. | |
| 4,735,339 | A | 4/1988 | Benge et al. | |
| 4,808,052 | A | 2/1989 | Bulso, Jr. et al. | |
| 4,809,861 | A | 3/1989 | Wilkinson et al. | |
| 4,890,759 | A | 1/1990 | Scanga et al. | |
| 4,891,484 | A | 1/1990 | Waggott et al. | |
| 4,940,158 | A | 7/1990 | Farrell et al. | |
| 4,941,306 | A | 7/1990 | Pfaffmann et al. | |
| 4,948,006 | A | 8/1990 | Okabe et al. | |
| 4,991,735 | A | 2/1991 | Biondich | |
| 5,025,123 | A | 6/1991 | Pfaffmann et al. | |
| 5,025,124 | A | 6/1991 | Alfredeen | |
| 5,046,637 | A | 9/1991 | Kysh | |
| 5,053,593 | A | 10/1991 | Iguchi | |
| 5,069,355 | A | 12/1991 | Matuszak | |
| 5,071,029 | A | 12/1991 | Umlah et al. | |
| 5,257,709 | A | 11/1993 | Okabe et al. | |
| 5,331,127 | A | 7/1994 | Chen | |
| 5,360,498 | A | 11/1994 | Blomqvist et al. | |
| 5,562,799 | A | 10/1996 | Ross et al. | |
| 5,590,807 | A | 1/1997 | Forrest et al. | |
| 5,598,734 | A | 2/1997 | Forrest et al. | |
| 5,721,028 | A | 2/1998 | Suzuki et al. | |
| 5,847,370 | A | 12/1998 | Sluka et al. | |
| 5,858,141 | A | 1/1999 | Repp et al. | |
| 5,971,259 | A | 10/1999 | Bacon | |
| 5,977,527 | A | 11/1999 | Preston et al. | |
| 6,043,471 | A | 3/2000 | Wiseman et al. | |
| 6,078,033 | A | 6/2000 | Bowers et al. | |
| 6,079,185 | A | 6/2000 | Palaniappan et al. | |
| 6,102,243 | A | 8/2000 | Fields et al. | |
| 6,104,013 | A | 8/2000 | Miller | |
| 6,116,500 | A | 9/2000 | Cahill | |
| 6,262,402 | B1 | 7/2001 | Isoyama et al. | |
| 6,408,498 | B1 | 6/2002 | Fields et al. | |
| 6,412,252 | B1 | 7/2002 | Sarles et al. | |
| 6,419,110 | B1 | 7/2002 | Stodd | |
| 6,460,723 | B2 | 10/2002 | Nguyen et al. | |
| 6,477,823 | B1 | 11/2002 | Kitterman et al. | |
| 6,499,622 | B1 | 12/2002 | Neiner | |
| 6,516,968 | B2 | 2/2003 | Stodd | |
| 6,555,801 | B1 | 4/2003 | LeMieux et al. | |
| 6,629,399 | B2 | 10/2003 | Sarles et al. | |
| 6,702,142 | B2 | 3/2004 | Neiner | |
| 6,725,630 | B2 | 4/2004 | Rea et al. | |
| 6,732,495 | B2 | 5/2004 | Sarles et al. | |
| 6,736,283 | B1 | 5/2004 | Santamaria et al. | |
| 6,747,252 | B2 | 6/2004 | Herzog | |
| 6,875,965 | B2 | 4/2005 | Herzog | |
| 6,915,553 | B2 | 7/2005 | Turner et al. | |
| 6,964,796 | B1 | 11/2005 | Koyama et al. | |
| 7,065,941 | B2 | 6/2006 | Sarles et al. | |
| 7,100,789 | B2 | 9/2006 | Nguyen et al. | |
| 7,119,310 | B2 | 10/2006 | Hammen et al. | |
| 7,137,524 | B2 | 11/2006 | Nomula | |
| 7,174,762 | B2 | 2/2007 | Turner et al. | |
| 7,318,536 | B2 | 1/2008 | Maravich et al. | |
| 7,341,163 | B2 | 3/2008 | Stodd | |
| 7,370,774 | B2 | 5/2008 | Watson et al. | |
| 7,380,684 | B2 | 6/2008 | Reed et al. | |
| 7,484,639 | B2 | 2/2009 | Maravich et al. | |
| 7,591,392 | B2 | 9/2009 | Watson et al. | |
| 7,772,518 | B2 | 8/2010 | Rajesh et al. | |
| 8,360,125 | B2 | 1/2013 | Schwiese et al. | |
| 2001/0032839 | A1 | 10/2001 | Herzog | |
| 2003/0089079 | A1 | 5/2003 | Rea et al. | |
| 2005/0029269 | A1 | 2/2005 | Stodd et al. | |
| 2006/0071005 | A1 | 4/2006 | Bulso | |
| 2006/0186127 | A1 | 8/2006 | Rajesh et al. | |
| 2007/0095847 | A1 | 5/2007 | Gruver et al. | |
| 2007/0187352 | A1 | 8/2007 | Kras et al. | |
| 2008/0041867 | A1 | 2/2008 | Jochem et al. | |
| 2008/0050207 | A1 | 2/2008 | Turner et al. | |
| 2008/0216960 | A1 | 9/2008 | Schwiese et al. | |
| 2009/0020543 | A1 | 1/2009 | Bulso | |
| 2009/0230079 | A1 | 9/2009 | Smolko | |
| 2009/0257847 | A1 * | 10/2009 | Schumann et al. | 413/2 |
| 2009/0269169 | A1 | 10/2009 | Turner et al. | |
| 2010/0006532 | A1 | 1/2010 | Lee | |
| 2010/0006571 | A1 | 1/2010 | Shibasaka et al. | |
| 2010/0038365 | A1 | 2/2010 | Ishida et al. | |
| 2010/0176134 | A1 | 7/2010 | Cramer | |
| 2011/0095030 | A1 | 4/2011 | Dunn et al. | |
| 2011/0226787 | A1 | 9/2011 | Yourist | |
| 2013/0059048 | A1 | 3/2013 | Price et al. | |
| 2013/0105467 | A1 | 5/2013 | Morin et al. | |
| 2013/0272820 | A1 | 10/2013 | Price et al. | |

FOREIGN PATENT DOCUMENTS

| | | | |
|---|---|---|---|
| EP | 0 099 159 | A2 | 1/1984 |
| EP | 0 420 519 | A1 | 4/1991 |
| EP | 0 742 152 | A1 | 11/1996 |
| GB | 1 078 696 | | 8/1967 |
| GB | 1 207 306 | | 9/1970 |
| GB | 2 051 627 | A | 1/1981 |
| GB | 2 067 158 | A | 7/1981 |
| GB | 2 384 478 | A | 7/2003 |
| JP | 8-151041 | A | 6/1996 |
| WO | WO 95/34469 | A1 | 12/1995 |
| WO | WO 96/37414 | A1 | 11/1996 |
| WO | WO 2006/050465 | A1 | 5/2006 |
| WO | WO 2007/014211 | A1 | 2/2007 |

OTHER PUBLICATIONS

International Search Report/Written Opinion for Application No. PCT/US2012/061615; dated Feb. 6, 2013.
International Preliminary Report on Patentability/Written Opinion for Application No. PCT/US2012/061615 dated Apr. 29, 2014.
International Search Report/Written Opinion for Application No. PCT/US2012/053062 dated Nov. 5, 2012.
International Preliminary Report on Patentability for Application No. PCT/US2012/053062 dated Mar. 4, 2014.
International Search Report and Written Opinion for Application No. PCT/US2013/035283 dated Jun. 25, 2013.
Office Action for U.S. Appl. No. 13/284,056 dated Jul. 31, 2014.
Office Action for U.S. Appl. No. 13/224,651 dated Mar. 28, 2014.
Office Action for U.S. Appl. No. 13/224,651 dated Jul. 10, 2014.

* cited by examiner

METHOD FOR APPLYING A METAL END TO A CONTAINER BODY

BACKGROUND OF THE INVENTION

The present disclosure relates to containers, particularly to containers having one or two metal ends applied to one or both ends of the container body and crimp-seamed or double-seamed onto the container body, and most particularly to such containers used for retort processing and in which the container body is non-metallic.

Traditionally, retort containers have been constructed substantially entirely of metal. For many decades the standard retort food container has been the metal can, in which a metal can body is closed by a pair of metal ends that are double-seamed onto the ends of the can body. Each metal end has an outer peripheral portion forming a "curl" that receives the end of the can body, and after each end is applied the curl and the end of the can body are rolled up together to form a double seam. This construction has the great advantage that it readily withstands retort processing without the seams being compromised, because the plastically deformed metal of the can body in the seam area tends to hold its deformed shape despite the stress and high temperature during retort.

More recently there has been a desire to construct retort containers that use less metal, motivated by the potential cost reduction and improved aesthetics that such a construction can offer. The development described in the present disclosure addresses this desire.

BRIEF SUMMARY OF THE INVENTION

In particular, the present disclosure describes a method that can be applied to retort containers having a non-metallic container body mated with one or two metal ends. In the conventional all-metal retort container, it is relatively easy to apply the metal end to the straight-walled container body because the method is tolerant of a relatively large diametral clearance between the chuck wall of the metal end and the side wall of the container body. With certain types of container constructions as proposed herein, however, there must be a much smaller clearance (and, preferably, an interference fit) between the chuck wall and the container body side wall in order to achieve a good seal in the seaming operation, as further described below. This makes it considerably more difficult to apply the metal end to the container body in a rapid automated process because even a slight misalignment between the axis of the metal end and the axis of the container body (or an out-of-round condition of the container body) can result in a failed application. Such a failure is a significant problem in a high-speed automated seaming line.

In accordance with the invention in one embodiment, a method for applying a closure to a container body is described herein. The method comprises the steps of:

(1) providing a container body having a side wall extending about a container body axis, the side wall having a lower end and an upper end, the upper end defining an upper edge that extends about a top opening of the container body, the side wall at the upper edge having an inner surface formed by a thermoplastic material, said inner surface having an inside diameter ID;

(2) providing a metal end, the metal end comprising a central portion and an outer peripheral portion extending generally radially outwardly from the central portion and extending circumferentially about the central portion, the peripheral portion having a radially outer part and a radially inner part, the radially outer part defining a curl having a lower surface that is generally concave downward in an axial direction of the metal end, the radially inner part defining a compound-angled chuck wall that extends generally downward and radially inward from the curl, wherein the chuck wall has an upper part adjacent the curl and a lower part joined to and positioned below the upper part, wherein the upper part of the chuck wall is substantially linear and oriented relative to the axial direction at an angle $\alpha 1$ and the lower part of the chuck wall is substantially linear and oriented relative to the axial direction at an angle $\alpha 2$ that is larger than $\alpha 1$, and wherein at least a bottom edge of the lower part of the chuck wall has an outside diameter that is smaller than the inside diameter ID of the container body side wall at the upper edge thereof by a diametral clearance $\Delta D$, and a top edge of the lower part of the chuck wall has an outside diameter that is at least as great as the inside diameter ID of the container body side wall at the upper edge thereof;

(3) positioning the metal end adjacent the upper edge of the container body side wall with the axial direction of the metal end generally aligned with the container body axis;

(4) pushing the metal end onto the container body such that the lower part of the chuck wall passes down into the top opening of the container body until the upper edge of the container body side wall is positioned within a channel defined between the upper part of the chuck wall and the curl; and (5) using the lower part of the chuck wall to guide the relative movement of the upper edge of the side wall into the channel such that a concentric relationship is established between the metal end and the upper edge of the container body side wall before the upper edge enters the channel.

By providing the compound-angled chuck wall on the metal end, the metal end's application to the container body side wall is facilitated because a substantial diametral clearance can be employed, which helps guide the metal end onto the container body and reduces chances of a misalignment occurring that could cause stoppage of a high-speed automated seaming line. As the side wall proceeds toward the channel, the diametral clearance diminishes and eventually is reduced to zero (or even an interference fit) in order to achieve the tight fit needed between the metal end and the container body for good sealing in the seaming operation.

In one embodiment, the diametral clearance $\Delta D$ is at least about 2% of the inside diameter ID. As an example, if the inside diameter is 3 inches, then $\Delta D$ is at least about 0.06 inch (i.e., there is a radial clearance of 0.03 inch on each side).

The method can further include the step of forming a crimp seam or a double seam between the metal end and the side wall of the container body. In particular embodiments, the metal end can be a laminated structure having a layer of metal and a coating of a thermoplastic material, and the method can further include the step of heat-sealing the metal end to the container body concurrently with or subsequent to the step of forming the crimp seam or double seam. The resulting heat seal between the metal end and the container body side wall essentially "locks" the seam so that it is substantially resistant to unrolling or loosening (e.g., during retort processing of the container, where increased internal pressure and elevated temperature tend to stress and weaken the seam).

In preferred embodiments, the angle $\alpha 1$ for the upper part of the compound-angled chuck wall is within a range of about 2° to about 10°, and the angle $\alpha 2$ for the lower part is within a range of about 20° to about 40°.

The method is applicable to various types of containers. The method can be applied when the container body is made substantially entirely of thermoplastic material, as well as when the container body has a composite construction (e.g., paper laminated with a thermoplastic film). The method is not limited to any particular shape or type of container body, but can be applied to various shapes (e.g., round, non-round, etc.) or types (e.g., thermoformed, extruded, blow-molded, etc.).

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 is an axially sectioned side view of a container body and a metal end positioned above the container body ready to be mated to the container body, and illustrates a method step of positioning the metal end adjacent the upper edge of the container body side wall with the axial direction of the metal end generally aligned with the container body axis, in accordance with an embodiment of the invention;

FIG. 2 illustrates a subsequent step of pushing the metal end onto the container body such that the lower part of the chuck wall passes down into the top opening of the container body until the upper edge of the container body side wall is positioned adjacent a channel defined between the upper part of the chuck wall and the curl, wherein the lower part of the chuck wall is used to guide the relative movement of the upper edge of the side wall towards the channel such that a concentric relationship is established between the metal end and the upper edge of the container body side wall before the upper edge enters the channel, in accordance with an embodiment of the invention;

Figure 7:
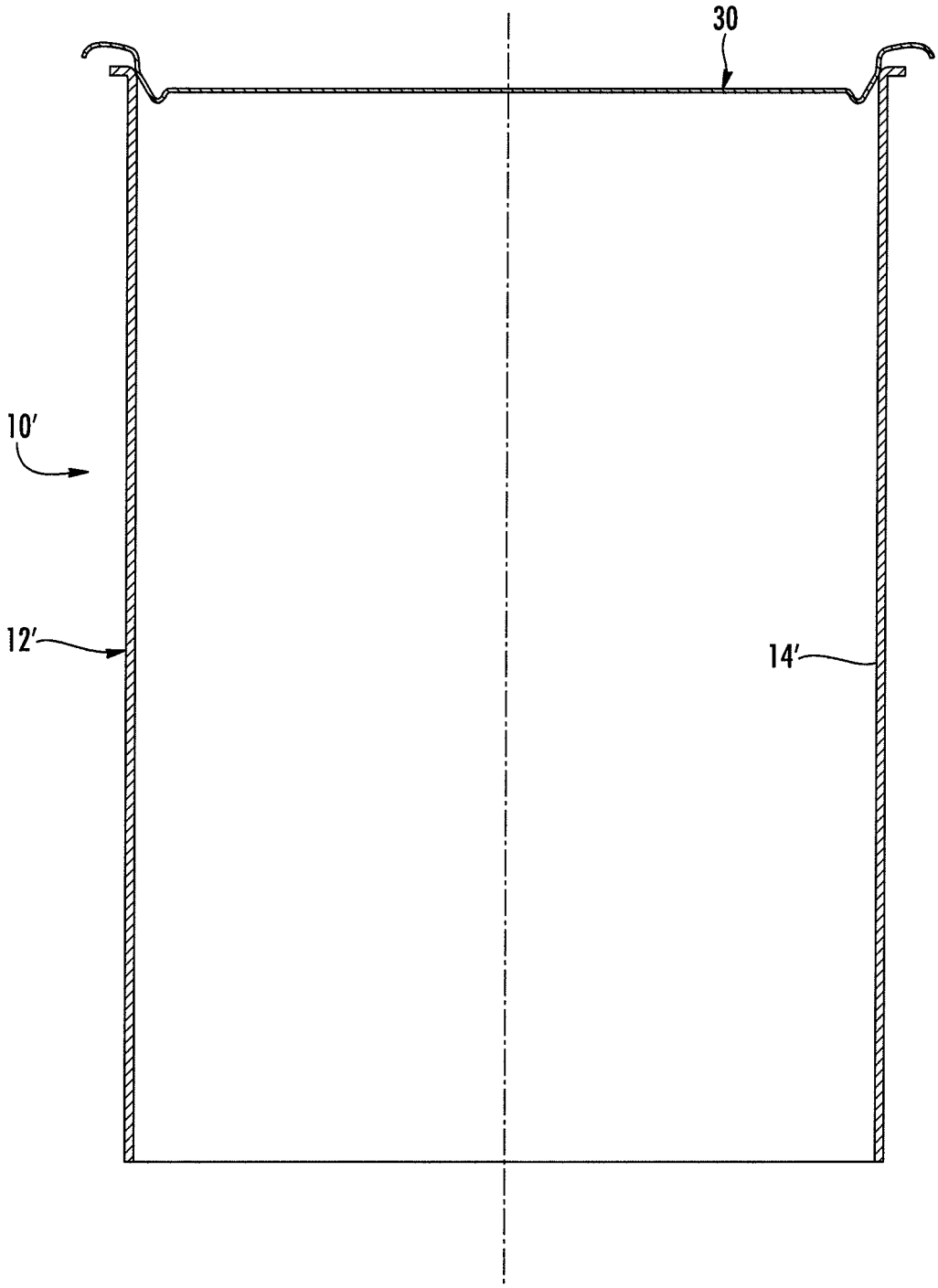
Figure 8:
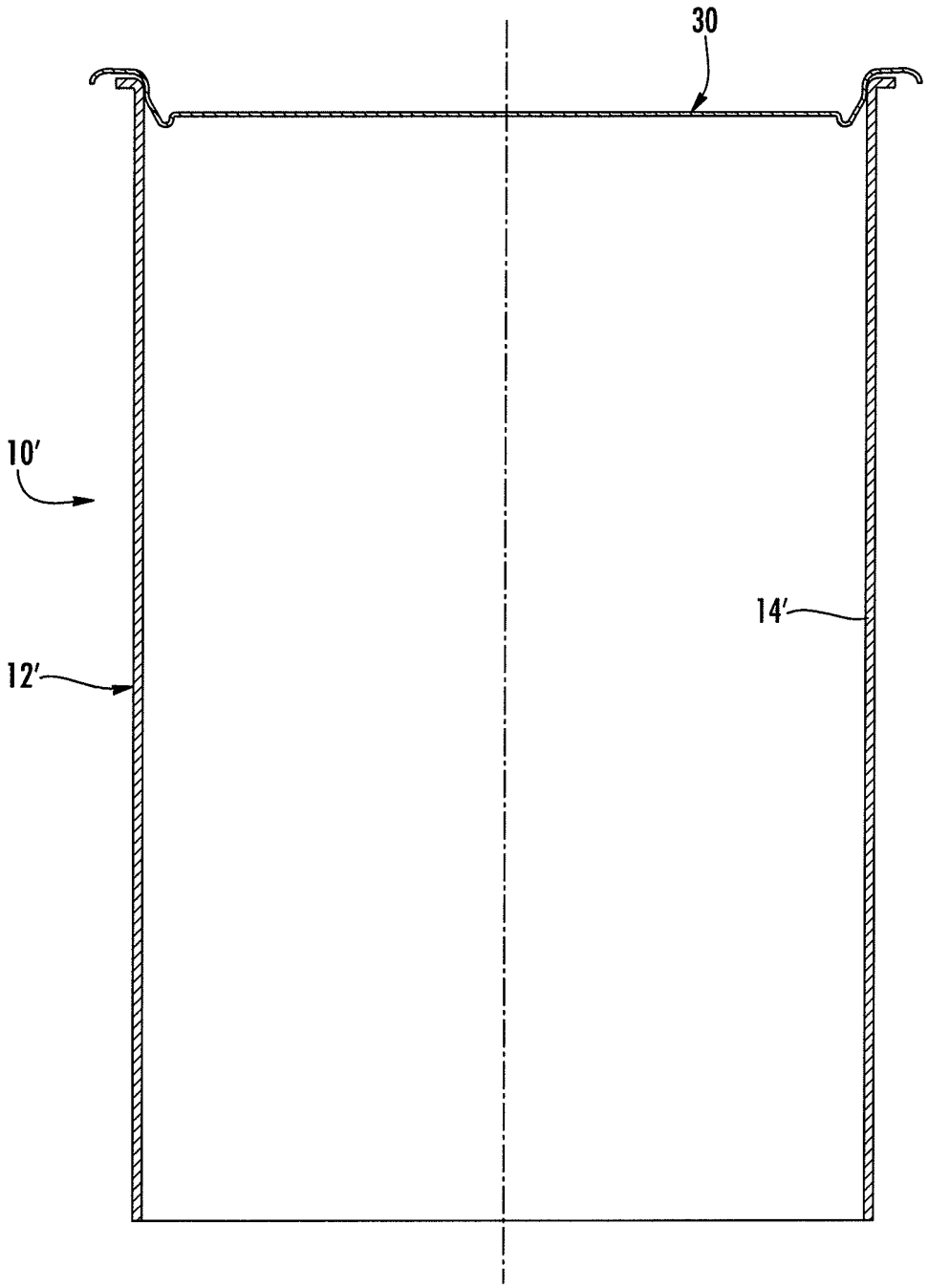
Figure 9:
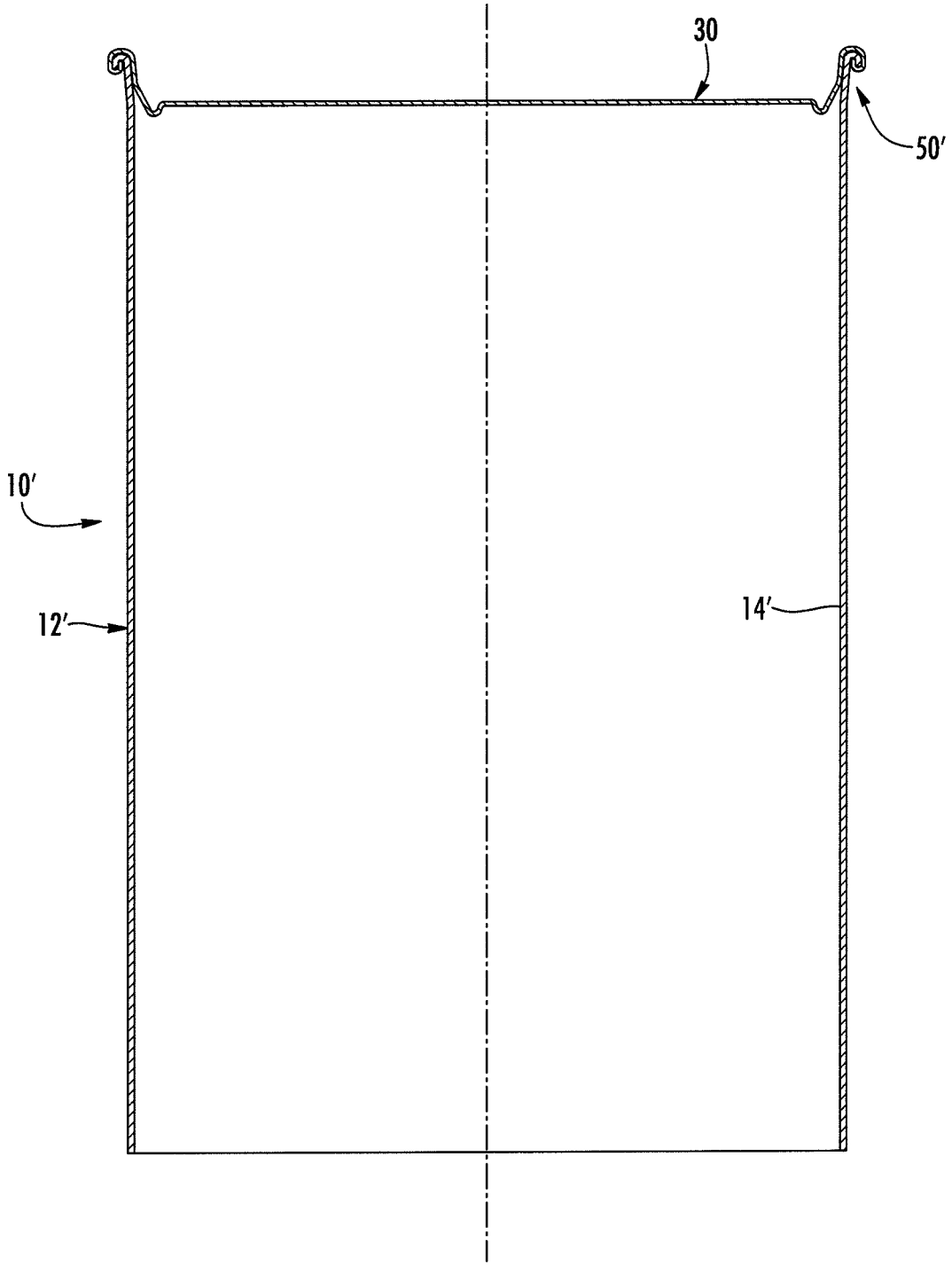

FIG. 7 is an axially sectioned side view of a flanged container body and a metal end positioned above the container body ready to be mated to the container body, and illustrates a method step of positioning the metal end adjacent the upper edge of the container body side wall with the axial direction of the metal end generally aligned with the container body axis, in accordance with a further embodiment of the invention;

FIG. 8 illustrates a subsequent step of pushing the metal end onto the flanged container body such that the lower part of the chuck wall passes down into the top opening of the container body until the flange of the container body side wall is positioned adjacent a channel defined between the upper part of the chuck wall and the curl, wherein the lower part of the chuck wall is used to guide the relative movement of the side wall towards the channel such that a concentric relationship is established between the metal end and the container body side wall before flange enters the channel, in accordance with the further embodiment of the invention; and FIG. 9 shows a completed double-seamed container in accordance with the further embodiment.

DETAILED DESCRIPTION OF THE INVENTION

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1 through 5 are a series of sequential views showing steps of a method for applying a closure to a container 10 in accordance with one embodiment of the invention. In these figures, a container body 12 is shown as having a side wall 14 extending about a container body axis A. The side wall has a lower end 16 and an upper end 18. The upper end defines an upper edge 20 that extends about a top opening 22 of the container body 12. The side wall 14 at the upper edge 20 has an inner surface 24 formed by a thermoplastic material. The inner surface 24 has an inside diameter ID. Container bodies useful in the practice of the present invention can be made via various processes and from various materials. For example, plastic container bodies can be extruded, molded, or thermoformed (e.g., a thermoformed bowl or tub). Composite container bodies (e.g., composite tubes of plastic with paper and/or metal) can also be used, as can metal container bodies formed by any suitable process.

It will be understood that, as previously noted, the side wall 14 can have any of various cross-sectional shapes, including round shapes as well as various non-round shapes. It will be further understood that use of the term "inside diameter" (ID) in the present application and claims does not imply that the container is round. As applied to both round and non-round containers, the inside diameter ID is the distance from a point A on the inner surface of the side wall to another point B directly opposite from point A, where points A and B are connected by a line that passes through a central axis of symmetry of the container.

Also shown in FIGS. 1-5 is a metal end 30. FIG. 6 depicts an enlarged view of the metal end 30. The metal end includes a central portion 32 and an outer peripheral portion 34 extending generally radially outwardly from the central portion 32 and extending circumferentially about the central portion 32. The peripheral portion 34 has a radially outer part 36 and a radially inner part 38. The radially outer part 36 defines a curl 40 having a lower surface that is generally concave downward in an axial direction of the metal end. The radially inner part 38 defines a compound-angled chuck wall 42 that extends generally downward and radially inward from the curl 40. The chuck wall 42 has an upper part 42*a* adjacent the curl 40 and a lower part 42*b* joined to and positioned below the upper part 42*a*. The upper part 42*a* of the chuck wall is substantially linear and oriented relative to the axial direction at an angle $\alpha$1 and the lower part 42*b* of the chuck wall is substantially linear and oriented relative to the axial direction at an angle $\alpha$2 that is larger than $\alpha$1.

The metal end 30 is configured such that at least a bottom edge 44 of the lower part 42*b* of the chuck wall has an outside diameter that is smaller than the inside diameter ID of the container body side wall 14 at the upper edge 20 thereof by a diametral clearance ΔD. Additionally, a top edge 46 of the lower part 42*b* of the chuck wall has an outside diameter that is at least as great as the inside diameter ID of the container body side wall 14 at the upper edge 20 thereof.

The method of applying the metal end 30 to the container body 12 is now described with reference to the sequential views in FIGS. 1 through 5. A shown in FIG. 1, a first step entails positioning the metal end 30 adjacent the upper edge 20 of the container body side wall 14 with the axial direction of the metal end 30 generally aligned with the container body axis A.

Figure 1:
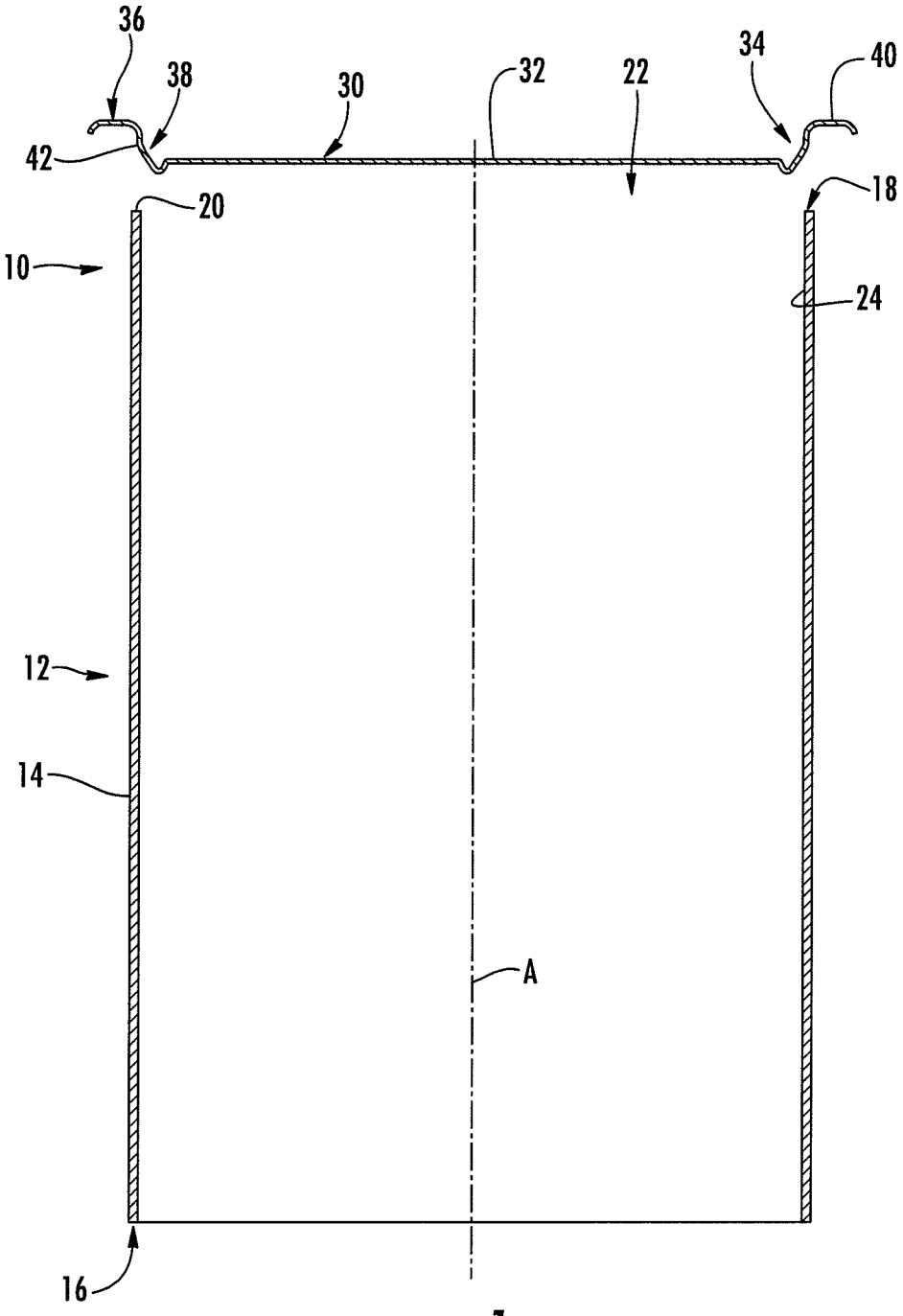
Figures 2, 2A:
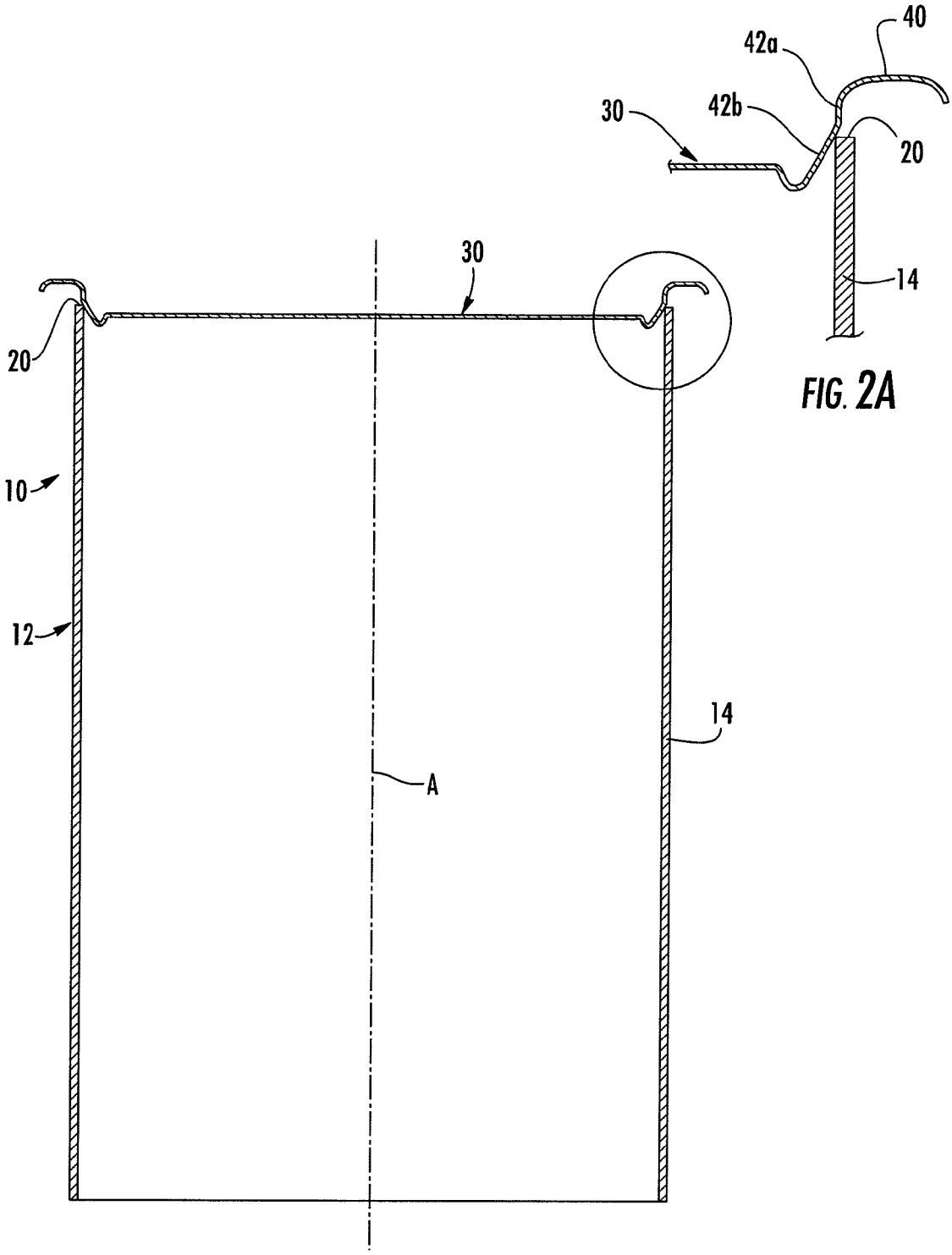
FIG. 2A is a magnified portion of FIG. 2.
Figure 3A:
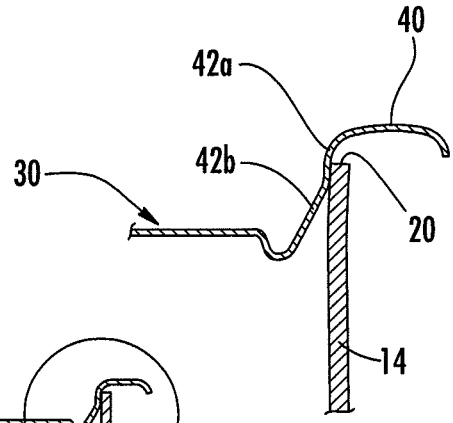
FIG. 3A is a magnified portion of FIG. 3.
Figure 3:
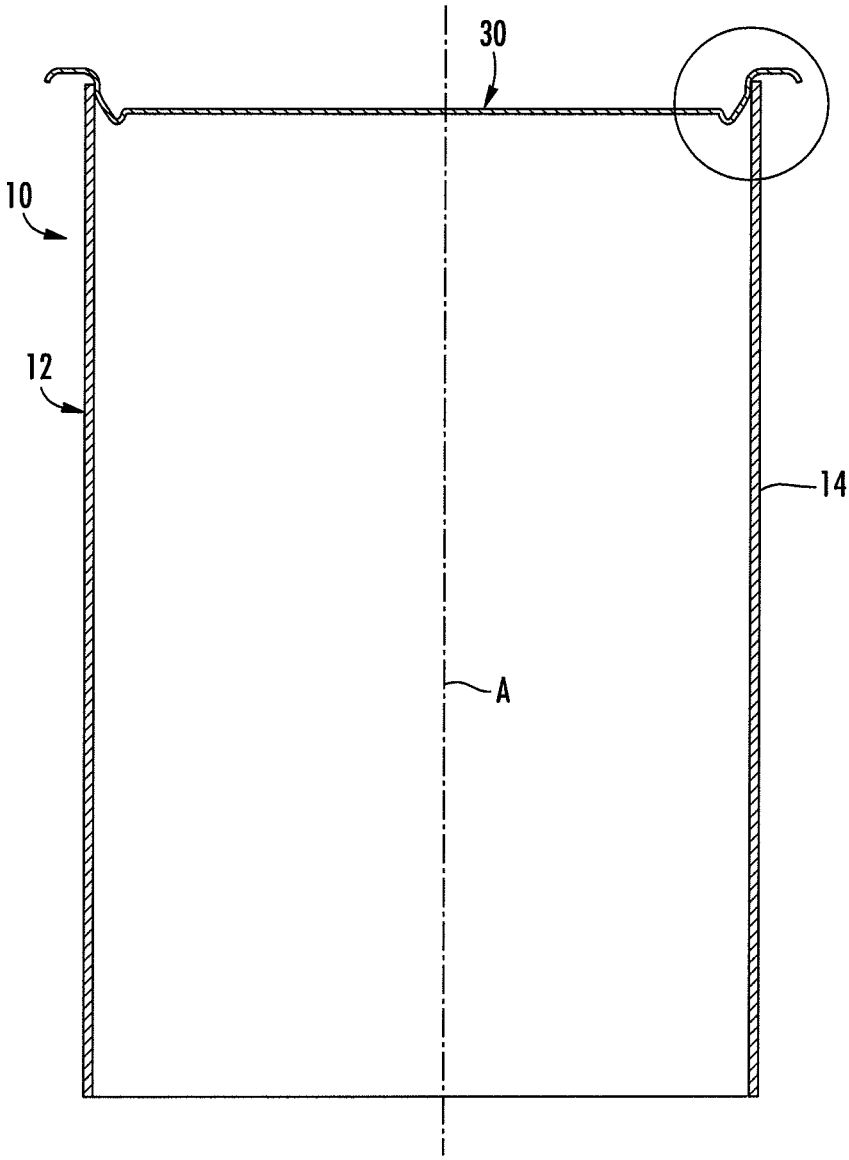
FIG. 3 illustrates a further subsequent step of pushing the metal end further onto the container body such that the upper edge of the side wall enters the channel, in accordance with an embodiment of the invention.

As shown in FIG. 2, a second step entails pushing the metal end 30 onto the container body 12 such that the lower part 42*b* of the chuck wall passes down into the top opening 22 of the container body 12 until, as depicted in FIG. 3, the upper edge 20 of the container body side wall 14 is positioned within a channel defined between the upper part 42*a* of the chuck wall and the curl 40.

In the process of pushing the metal end 30 onto the container body 12, the lower part 42*b* of the chuck wall is used to guide the relative movement of the upper edge 20 of the side wall 14 into the channel such that a concentric relationship is established between the metal end 30 and the upper edge 20 of the container body side wall 14 before the upper edge 20 enters the channel. This is illustrated by the comparison between FIGS. 2 and 3.

Figures 4, 4A:
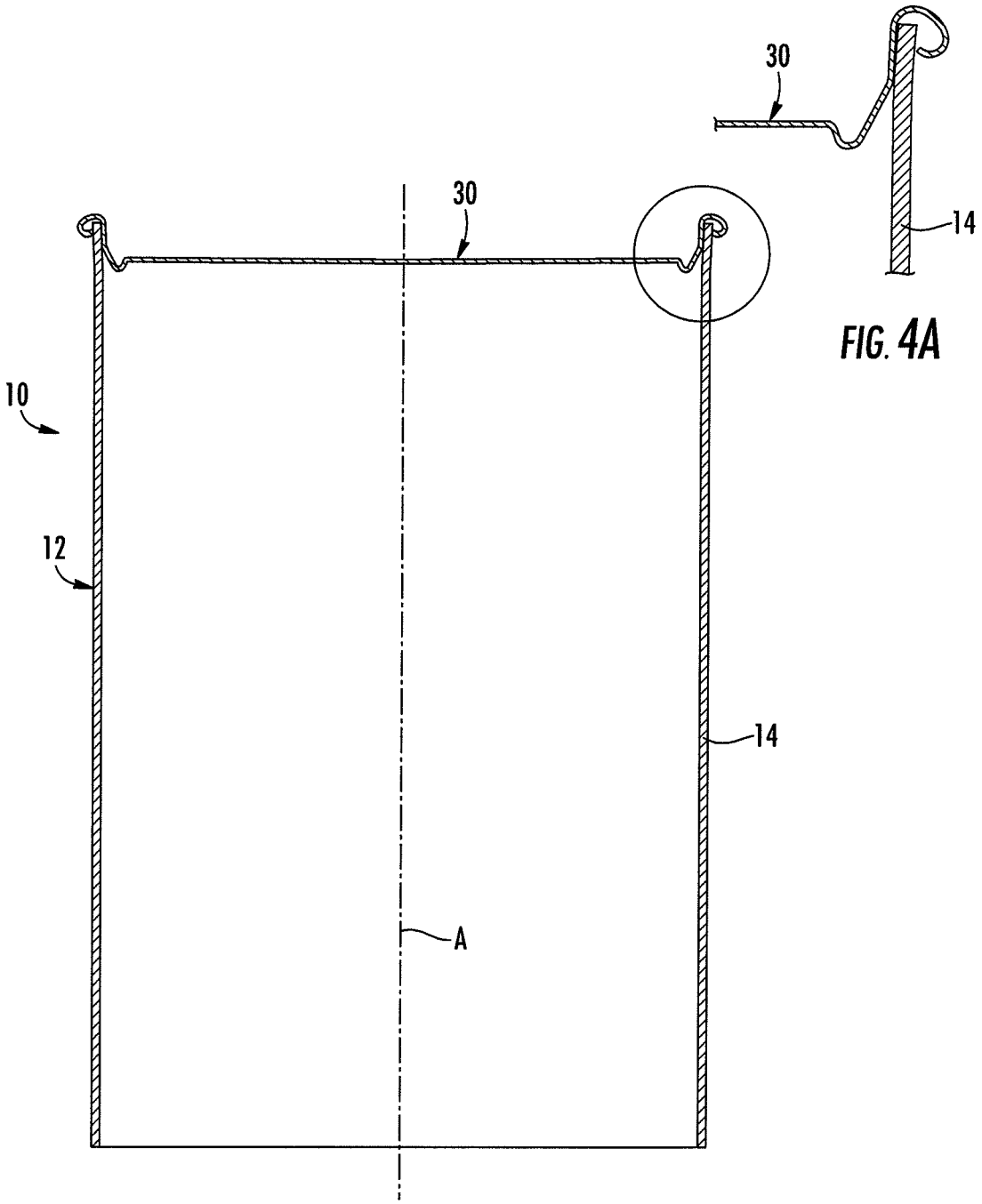
FIG. 4 illustrates a further subsequent step of deforming the curl of the metal end to capture the upper edge of the side wall between the curl and the upper part of the chuck wall, in accordance with an embodiment of the invention.
FIG. 4A is a magnified portion of FIG. 4.
Figures 5, 5A:
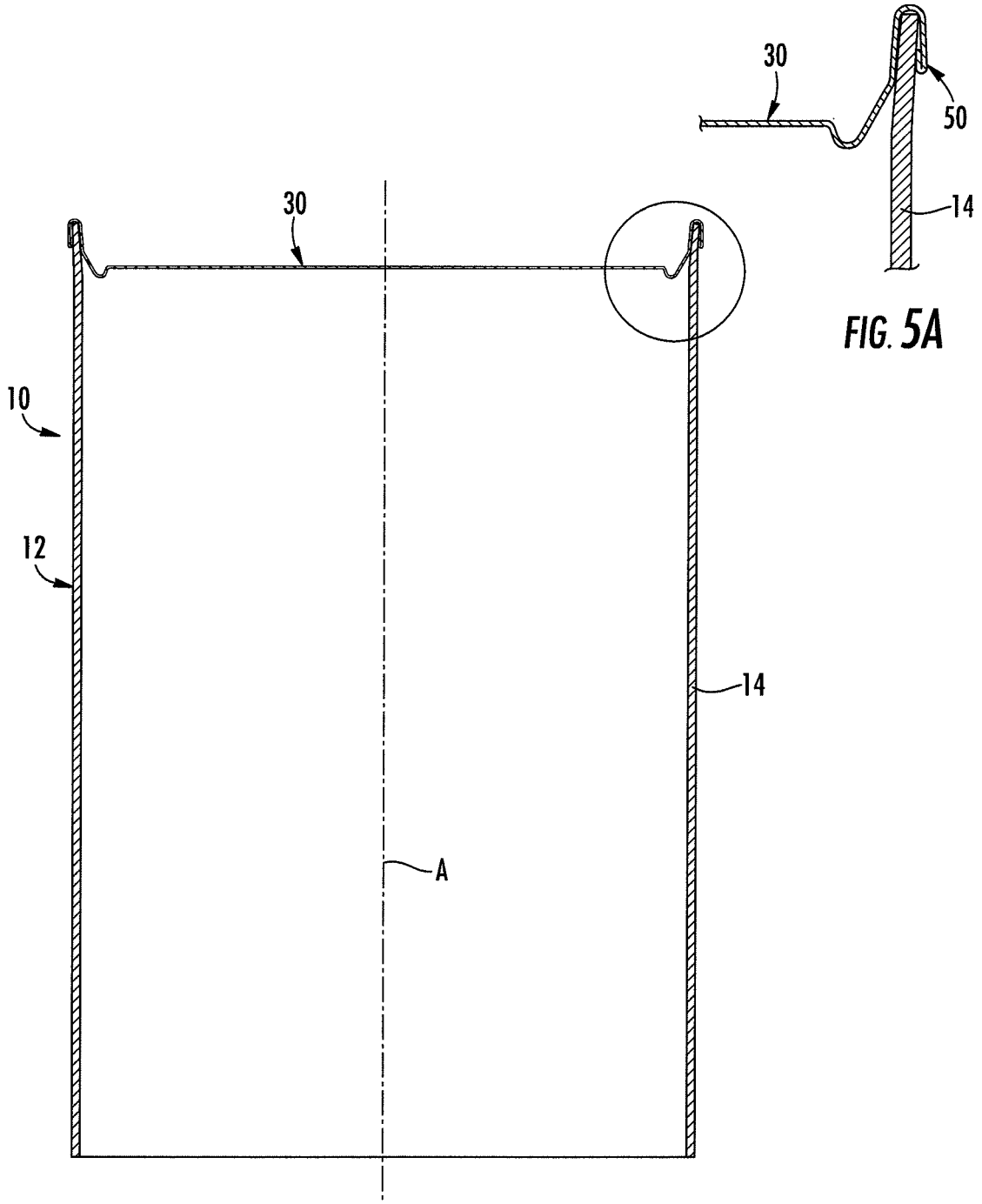
FIG. 5 illustrates a still further subsequent step of crimping the metal end onto the upper edge of the side wall, in accordance with an embodiment of the invention.
FIG. 5A is a magnified portion of FIG. 5.
Figure 6:
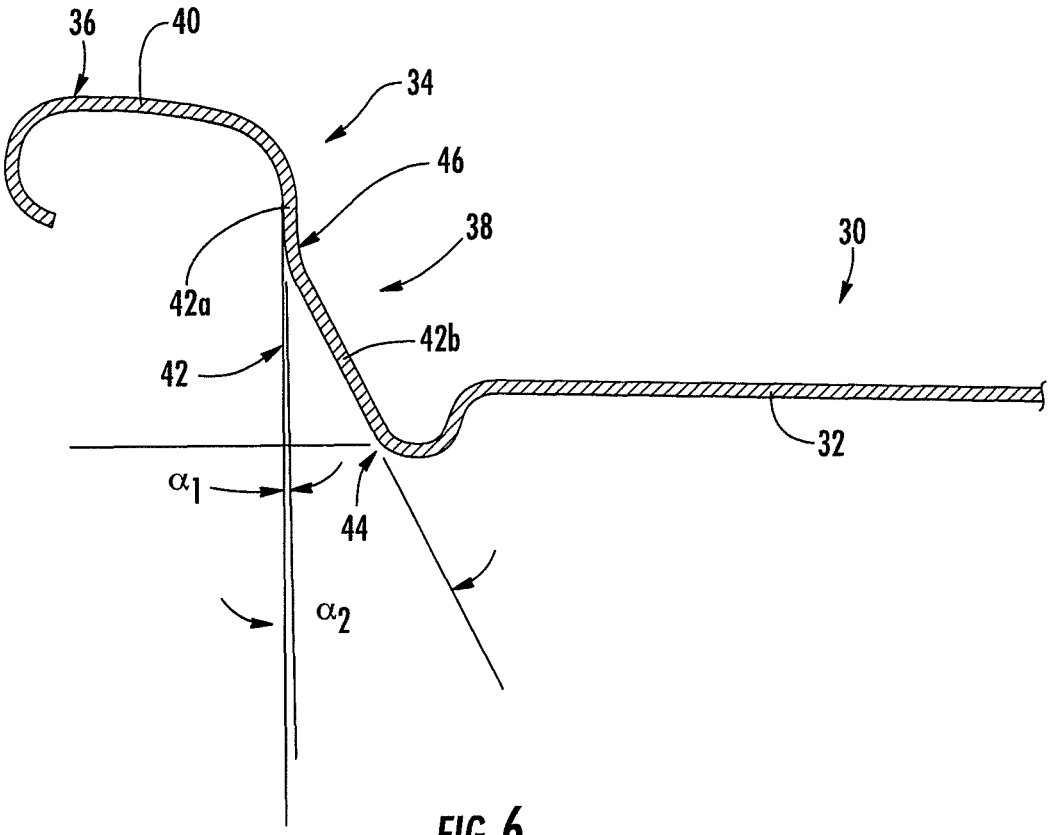
FIG. 6 is a magnified view of the outer peripheral portion of the metal end, in accordance with an embodiment of the invention.

Next, as illustrated in FIGS. 4 and 5, a crimp seam 50 is formed between the metal end 30 and the side wall 14 of the container body. Alternatively, if desired, a double seam can be formed.

Advantageously the diametral clearance ΔD between the lower edge 44 of the lower part 42*b* of the chuck wall and the inner surface 24 of the container body side wall 14 is at least about 2% of the inside diameter ID of the inner surface 24.

Advantageously the angle α1 is within a range of about 2° to about 10° and the angle α2 is within a range of about 20° to about 40°.

The method can be applied to containers and metal ends having various configurations (including round or non-round). For example, the metal ends can have various make-ups. In one embodiment, the metal end is a laminated structure having a layer of metal and a coating of a thermoplastic material. In this case, the method can include the additional step of heat-sealing the metal end to the container body concurrently with or subsequent to the step of forming the crimp seam or double seam. Such heat-sealing can be accomplished using any suitable heating device or method, including resistive heating, inductive (radio frequency) heating, ultrasonic heating, etc.

The method is applicable to container bodies of various constructions and materials. In one embodiment the container body 14 is made substantially entirely of thermoplastic material. For example, the container body can be a blow-molded container body having a bottom wall integrally joined to the side wall.

Alternatively the container body 14 can be an extruded container body having an open lower end 16 as shown in FIGS. 1-5. In this case, the lower end 16 of the container body is closed by a second metal end (not shown) substantially identical to the metal end 30 for the upper end.

The container described above employs a non-flanged (straight-walled) container body, but the invention is not limited to non-flanged container bodies. FIG. 7 shows an axially sectioned side view of container 10' having a flanged container body 12' and a metal end 30 positioned above the container body ready to be mated to the container body. FIG. 7 illustrates a method step of positioning the metal end 30 adjacent the upper edge of the flanged container body side wall 14' with the axial direction of the metal end generally aligned with the container body axis.

FIG. 8 illustrates a subsequent step of pushing the metal end 30 onto the flanged container body 12' such that the lower part of the chuck wall passes down into the top opening of the container body until the flange of the container body side wall is positioned adjacent a channel defined between the upper part of the chuck wall and the curl. In accordance with the invention, the lower part of the chuck wall is used to guide the relative movement of the side wall 14' towards the channel such that a concentric relationship is established between the metal end and the container body side wall before flange enters the channel.

FIG. 9 shows a completed container having a double seam 50' formed by rolling up the curl of the metal end and the flange of the container body. As with the previously described embodiment, the metal end can be a laminated structure having a layer of metal and a coating of a thermoplastic material, and the method can include the additional step of heat-sealing the metal end to the container body concurrently with or subsequent to the step of forming the double seam. Such heat-sealing can be accomplished using any suitable heating device or method, including resistive heating, inductive (radio frequency) heating, ultrasonic heating, etc.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for applying a closure to a container, comprising the steps of:

(1) providing a container body having a side wall extending about a container body axis, the side wall having a lower end and an upper end, the upper end defining an upper edge that extends about a top opening of the container body, the side wall at the upper edge having an inner surface formed by a thermoplastic material, said inner surface having an inside diameter ID;

(2) providing a metal end, the metal end comprising a central portion and an outer peripheral portion extending generally radially outwardly from the central portion and extending circumferentially about the central portion, the peripheral portion having a radially outer part and a radially inner part, the radially outer part defining a curl having a lower surface that is generally concave downward in an axial direction of the metal end, the radially inner part defining a compound-angled chuck wall that extends generally downward and radially inward from the curl, wherein the chuck wall has an upper part adjacent the curl and a lower part joined to and positioned below the upper part, wherein the upper part of the chuck wall is substantially linear and oriented relative to the axial direction at an angle α1 and the lower part of the chuck wall is substantially linear and oriented relative to the axial direction at an angle α2 that is larger than α1, and wherein at least a bottom edge of the lower part of the chuck wall has an outside diameter that is smaller than the inside diameter ID of the container body side wall at the upper edge thereof by a diametral clearance ΔD, and a top edge of the lower part of the chuck wall has an outside diameter that is at least as great as the inside diameter ID of the container body side wall at the upper edge thereof;

(3) positioning the metal end adjacent the upper edge of the container body side wall with the axial direction of the metal end generally aligned with the container body axis;

(4) pushing the metal end onto the container body such that the lower part of the chuck wall passes down into the top opening of the container body until the upper edge of the container body side wall is positioned within a channel defined between the upper part of the chuck wall and the curl; and (5) using the lower part of the chuck wall to guide the relative movement of the upper edge of the side wall into the channel such that a concentric relationship is established between the metal end and the upper edge of the container body side wall before the upper edge enters the channel.

2. The method of claim 1, wherein the diametral clearance ΔD is at least about 2% of the inside diameter ID.

3. The method of claim 1, further comprising the step of forming a crimp seam between the metal end and the side wall of the container body.

4. The method of claim 3, wherein the metal end is a laminated structure having a layer of metal and a coating of a thermoplastic material, and further comprising the step of heat-sealing the metal end to the container body concurrently with or subsequent to the step of forming the crimp seam.

5. The method of claim 1, further comprising the step of forming a double seam between the metal end and the side wall of the container body.

6. The method of claim 5, wherein the metal end is a laminated structure having a layer of metal and a coating of a thermoplastic material, and further comprising the step of heat-sealing the metal end to the container body concurrently with or subsequent to the step of forming the double seam.

7. The method of claim 1, wherein the angle $\alpha 1$ is within a range of about 2° to about 10° and the angle $\alpha 2$ is within a range of about 20° to about 40°.

8. The method of claim 1, wherein the container body is provided to be made substantially entirely of thermoplastic material.

9. The method of claim 8, wherein the container body is provided to be a blow-molded container body having a bottom wall integrally joined to the side wall.

10. The method of claim 8, wherein the container body is provided to be a thermoformed container body having a bottom wall integrally joined to the side wall.

11. The method of claim 8, wherein the container body is provided to be an extruded container body having an open lower end.

12. The method of claim 11, wherein the lower end of the container body is substantially identical to the upper end thereof, wherein a second metal end substantially identical to the metal end for the upper end is provided, and wherein the second metal end is applied to the lower end of the container body using steps (3) through (5).

13. The method of claim 1, wherein the container body is provided to be a composite container body.

14. The method of claim 1, wherein the container body is provided to be a metal container body.

* * * * *